United States Patent [19]

Norris

[11] Patent Number: 4,976,383

[45] Date of Patent: Dec. 11, 1990

[54] BACKPACK BELT CONSTRUCTION

[76] Inventor: Gary R. Norris, Hwy. 321, Box 273-B, Sugar Grove, N.C. 28679

[21] Appl. No.: 435,620

[22] Filed: Nov. 13, 1989

[51] Int. Cl.[5] ..... A45F 3/04; B65H 75/48

[52] U.S. Cl. ..... 224/215; 242/96; 242/107.4 R; 224/262

[58] Field of Search ..... 224/209, 210, 211, 215, 224/222, 262, 162, 907; 242/96, 107.4 R; 244/151 R, 122 R, 122.46, 122 B; 182/3

[56] References Cited

U.S. PATENT DOCUMENTS

| | | | |
|---|---|---|---|
| 3,341,250 | 9/1967 | Rasmussen | 244/122 R |
| 3,424,134 | 1/1969 | Rosenblum | 244/151 R |
| 3,692,253 | 9/1972 | Curran | 242/107.4 R |
| 4,449,654 | 5/1984 | Cappis | 224/148 |
| 4,545,414 | 10/1985 | Baum | 150/525 |
| 4,676,418 | 6/1987 | Lowe | 224/215 |
| 4,688,643 | 8/1987 | Carter et al. | 169/33 |
| 4,739,913 | 4/1988 | Moore | 224/215 |
| 4,750,654 | 6/1988 | Menetrier | 224/211 |

FOREIGN PATENT DOCUMENTS

| | | | |
|---|---|---|---|
| 0048809 | 4/1982 | European Pat. Off. | 242/107.4 R |
| 2447708 | 10/1980 | France | 242/107.4 R |

*Primary Examiner*—Henry J. Recla
*Assistant Examiner*—Glenn T. Barrett

[57] ABSTRACT

A backpack having one or more belt structures that can be quickly adjusted to fit persons of different physical size (fat or thin). Each belt structure includes a flexible belt element wound a multiple number of turns around a rotary reel located within a small housing disposed on the frontal side area of the person wearing the backpack. A spiral clock spring within the housing exerts a force on the reel tending to pull the belt element into the housing, such that the belt structure adapts to an individual person's torso measurements. The backpack would enjoy primary usage by firefighters who may need to fasten the backpack in place very quickly in order to move into a fire zone where equipment attached to the backpack is useful or essential.

14 Claims, 1 Drawing Sheet

BACKPACK BELT CONSTRUCTION

BACKGROUND AND SUMMARY OF THE INVENTION

This invention relates to backpacks that can be used by firefighters and hikers to carry equipment while moving from place to place.

Firefighters sometimes carry air tanks or water tanks while working in smoky or fire-laden atmospheres.

S. Carter U.S. Pat. No. 4,688,643 shows a firefighter backpack that includes a flexible water tank having a hose connection to a hand-held water pump. L. Cappes U.S. Pat. No. 4,449,654 shows a backpack usable by runners and skiers to support bottle-type containers for water or other liquids.

Backpacks used by firefighters usually include a panel (equipment support) positionable on the person's back, and two laterally-spaced shoulder straps adapted to extend from the panel over the wearer's shoulders and downwardly onto his chest area. Side straps extend from edges of the panel forwardly to connect with the shoulder straps. The side straps continue onto the front of the wearer to form a belt structure around the waist and/or chest area of the firefighter. Mating buckle components on the free ends of the belt elements lock the belt structure in place. Usually there is an upper belt structure adapted to encircle the wearer's chest and a lower belt structure adapted to encircle the wearer's waist.

Frequently firefighters must put on their backpacks quickly in order to move as rapidly as possible into a fire zone for rescue or fire suppression purposes. When the previous wearer of the backpack was of a different physical size than the person then attempting to put on the backpack it becomes difficult to quickly fit the belt structures to the person's chest and/or waist. Each belt structure must first be lengthened or shortened, depending on whether the present wearer is fatter or thinner than the previous wearer.

The use of conventional buckle structures is not conducive to rapid major changes in effective belt length, i.e. changes greater than about one foot. In the case of major changes in belt length the entire belt must be shifted circumferentially in order to keep the buckle components on the frontal area of the wearer. Such shifting is often difficult to accomplish rapidly because the belt must be simultaneously pulled and/or pushed through a multiple number of belt loops.

The present invention proposes a backpack having one or more belt structures that are capable of rapid changes in belt length without the need for bodily shifting such belt structures circumferentially or through belt-retention loops.

THE DRAWINGS

DESCRIPTION OF A PREFERRED EMBODIMENT OF THE INVENTION

Figure 1:
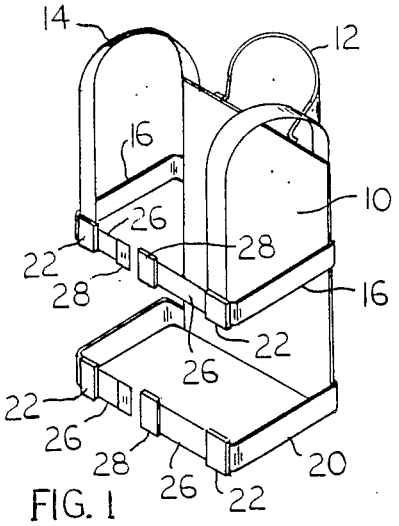
FIG. 1 is a perspective view of a backpack embodying the present invention.

FIG. 1 shows a backpack that includes a fabric panel 10 adapted to extend along the wearer's back. A vertically-extending fabric pocket member 12 may be sewn onto the rear face of panel 10. The pocket can be used to support (and retain therein) a tank, not shown. The non-illustrated tank can be a compressed air tank, or a water tank, or a fire extinguisher tank (e.g. carbon dioxide or Halon) when the backpack is to be used by firefighters.

Two laterally-spaced shoulder straps 14 extend from the upper edge of panel 10 for positionment over the wearer's shoulders. Straps 14 extend forwardly and downwardly to overlie the chest area of the wearer. Side straps 16 extend horizontally from side edges of panel 10 for disposition along the person's sides underneath his arm pits. The front ends of straps 16 may be sewn or otherwise attached to the lower front ends of shoulder straps 14. The two juncture points between the respective straps 14 and 16 are widely spaced, e.g. at least eighteen inches.

Figure 2:
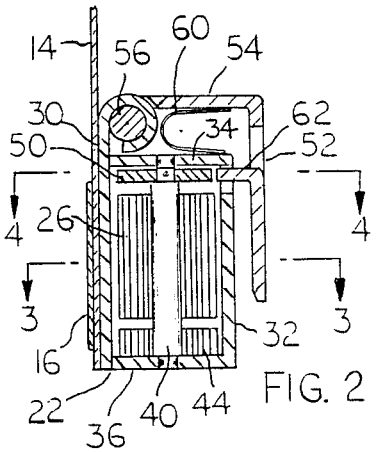
FIG. 2 is an enlarged sectional view through a belt extension-retraction mechanism employed in the FIG. 1 backpack.
Figure 3:
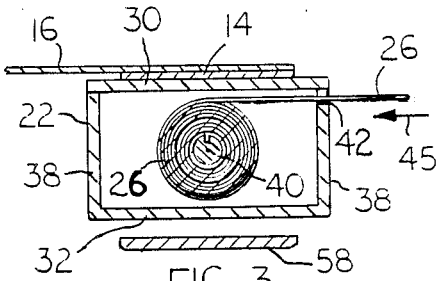
FIG. 3 is a sectional view taken on line 3—3 in FIG. 2.
Figure 4:
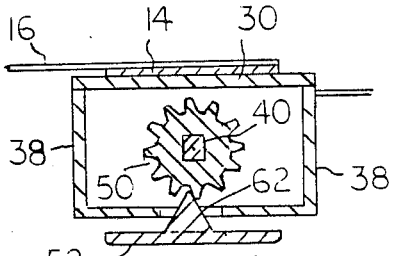
FIG. 4 is a sectional view taken on line 4—4 in FIG. 2.

Two lower side straps 20 extend horizontally from side edges of panel 10 at about waist level. Four similarly constructed housings 22 are mounted on (at) the front ends of the four side straps 16, 16, 20, 20. Each housing may be constructed as shown in FIGS. 2 through 4 (except that the left and right housings are mirror images of one another). Each housing 22 contains a flexible woven belt element 26 that can be manually extended from the housing or retracted into the housing.

The aligned free ends of belt elements 26 are equipped with quick-connect buckle fasteners 28 of the type used in automotive seat belts. In each case one of the fasteners will be a male structure, and the mating fastener will be a female structure designed to receive and retain the male structure by a straight pushing motion of the male structure. The female component will have a manual latch release element mounted thereon for rapid disconnection of the mating fasteners.

My invention is more especially related to belt-containment housings 22 and the associated internal mechanisms, as illustrated in FIGS. 2 through 4. Each housing includes a vertical back plate 30 secured to a side strap 16 or 20. Each housing further includes a front wall 32, top wall 34, bottom wall 36, and two side walls 38. A rotary spindle (reel) 40 extends between walls 34 and 36 for supporting a woven fabric belt component 26 in a wound condition within the housing.

One end of belt component 26 is attached to spindle 40. As shown in FIG. 3, the belt component extends out of the housing through a slot 42 formed in the rear edge of housing side wall 38. The space below the wound section of belt component 26 (in FIG. 2) is occupied by a clock spring 44 that has one end thereof affixed to spindle 40 and the other end thereof affixed to housing 22. Spring 44 is wound to exert a rotary force on spindle 40 tending to draw belt component 26 into the housing, as indicated by arrow 45 in FIG. 3.

The space above the wound section of belt component 26 is occupied by a toothed wheel (disk) 50 that is affixed to spindle 40 for conjoint rotation therewith. A cooperating detent structure 52 is provided for engagement with wheel 50 to prevent rotary movement of spindle 40. Detent structure 52 comprises a plate-like member of right angular cross section (as viewed in FIG. 2). A horizontal section 54 of this member has a hinged connection 56 with the upper end of housing wall 30. The detent member further includes a vertical plate section 58 located in front of the housing for manual push action of the detent structure to its disengaged condition.

A leaf spring 60 is interposed between housing wall 34 and detent wall 54 to normally bias the detent structure 52 to its operative position engaged with toothed wheel 50 (as shown in FIG. 4). A tang 62 is struck out of vertical wall 58 to extend into one of the tooth spaces in wheel 50. Application of a manual push force on vertical plate 58 causes the detent structure to swing in a clockwise direction around the axis of hinge 56; tang 62 moves generally downward out of engagement with toothed wheel 50.

When the detent structure (tang 62) is disengaged from wheel 50 the clock spring 44 automatically pulls belt component 26 into housing 22, as indicated by arrow 45 in FIG. 3. When the manual pressure on wall 59 is removed spring 60 returns the detent structure to its operative position (FIG. 4). Toothed wheel 50 and detent structure 52 cooperatively constitute a manually-operable latch means for selectively locking reel (spindle) 40 in selected positions of adjustment, as necessary to extend or retract the associated belt structure 26 to a desired position required for a snug fit on different individual wearers.

In usage of the backpack the wearer will initially put the backpack on so that belt elements 26 are longer than the available space between the horizontally aligned housings 22. Buckle fasteners 28 will be snapped together with the belt elements in a loosened condition. Thereafter manual pressure will be applied to latch-actuation walls (plates) 58; this will enable the associated clock springs 44 to retract the belt elements into housings 22. The clock springs are of sufficient strength to obtain a snug fit of the belt elements on the wearer's torso. Release of manual pressure from walls 58 enables the latch structures to lock the reel structures 40 in positions of adjustment wherein the side straps and belt elements 26 cooperatively form a constant length belt device sized to the physical measurements of the wearer.

The primary advantage of the described belt system is that it is quickly adjustable to the overall length necessary to fit individual persons (fat or thin). The person does not have to figure out what length of belt he needs. He lets the clock springs 44 automatically adjust the belt length after buckle elements 28 have been snapped together.

The drawings show a belt construction that employs two housings 22 attached to the associated side straps 16 or 20. It would be possible to have an arrangement wherein only one of the side straps has a housing 22 carried thereon However, the "two housings" arrangement is preferred.

The invention was conceived primarily for use by firefighters, although it could also be used by runners, walkers, skiers or other outdoors persons requiring the use of backpacks.

I claim:

1. A backpack comprising a panel adapted to extend along the wearer's back; two laterally-spaced shoulder straps connected to an upper edge of said panel for extension over the wearer's shoulders and downwardly onto his chest area; two side straps extending between side edges of the panel and frontal sections of said shoulder straps; a belt structure forming a frontal extension of each side strap for horizontal disposition on the front of the wearer wherein each belt structure as a free end; and quick-connect buckle components located on the free ends of the belt structures, whereby the belt structures can be connected together at a point along the front of the wearer; at least one of said belt structures comprising a housing attached to the associated side strap, a rotary reel located within said housing, and a flexible belt element wound on and around the reel a multiple number of turns wherein one of said quick-connect buckle components is attached to said flexible belt element, whereby said belt element can be extended from the housing or retracted into the housing so as to fit snugly around different size wearers.

2. The backpack of claim 1, and further comprising spring return means connected to said rotary reel for exerting a retractive force on the associated belt element.

3. The backpack of claim 2, and further comprising a manual latch means connected to said rotary reel for locking said reel in selected positions of rotary adjustment.

4. The backpack of claim 3, wherein said latch means comprises a toothed wheel affixed to said reel and a manually-actuable detent element swingably mounted on said housing.

5. The backpack of claim 4, wherein said reel has a vertical rotational axis, and said detent element has a horizontal swing axis.

6. The backpack of claim 5, wherein said detent element is a plate structure that includes a horizontal plate section extending above the associated housing and a vertical plate section extending downwardly in front of the housing.

7. The backpack of claim 5, wherein the swing axis for the detent element is located at a rear edge of the horizontal plate section.

8. The backpack of claim 1, wherein said rotary reel comprises a vertical spindle having two ends.

9. The backpack of claim 8, and further comprising a toothed latch wheel carried on said spindle near one of its ends, and a belt return clock spring carried on the spindle near its other end.

10. A backpack comprising a panel adapted to extend along the wearer's back; shoulder-engagement means connected to said panel for transferring the weight of the panel to the wearer's shoulders; two side straps extending horizontally from side edges of the panel for disposition along the wearer's sides; belt structures forming frontal continuations of said side straps wherein each belt structure as a free end; and quick-connect buckle components located on the free ends of the belt structures; at least one of said belt structures comprising a housing attached to the associated side strap, a rotary reel located within said housing, and a flexible belt element wound on and around the reel a multiple number of turns wherein one of said quick-connect buckle components is attached to said flexible belt element, whereby said belt element can be extended from the housing or retracted into the housing.

11. The backpack of claim 10, and further comprising spring means connected to said rotary reel for exerting a retractive force on the associated belt element; and a manual latch means connected to said rotary reel for locking said reel in selected positions of rotary adjustment.

12. The backpack of claim 11, wherein said latch means comprises a toothed wheel affixed to said reel and a manually-actuable detent element swingably mounted on said housing.

13. The backpack of claim 12 wherein said reel has a vertical rotational axis, and said detent element has a horizontal swing axis.

14. The backpack of claim 13, wherein said detent element comprises a vertical push plate located in front of the housing.

* * * * *